US005394893A

United States Patent [19]

Coleman et al.

[11] Patent Number: 5,394,893

[45] Date of Patent: Mar. 7, 1995

[54] MODULAR STYLE MULTI-SEPARATOR

[75] Inventors: G. A. John Coleman, Richmond, Va.; Michael J. Konar, Raleigh, N.C.

[73] Assignee: Universal Leaf Tobacco Co., Ltd., Richmond, Va.

[21] Appl. No.: 140,306

[22] Filed: Oct. 22, 1993

[51] Int. Cl.[6] ..... A24B 5/10

[52] U.S. Cl. ..... 131/110; 131/109.2

[58] Field of Search ..... 131/109.2, 110; 209/639, 535

[56] References Cited

U.S. PATENT DOCUMENTS 4,465,194 8/1984 Coleman .
4,475,562 10/1984 Thatcher et al. .
5,063,944 11/1991 Parker ..... 131/109.2
5,099,863 3/1992 Coleman ..... 131/312
5,205,415 4/1993 Surtees .

FOREIGN PATENT DOCUMENTS 2231770 11/1990 United Kingdom .

OTHER PUBLICATIONS

U.S. patent application No. 07/804,741 (Coleman et al.).

*Primary Examiner*—Jennifer Bahr
*Attorney, Agent, or Firm*—Cushman, Darby & Cushman

[57] ABSTRACT

Apparatus for separating lighter particles from tobacco particles contained in threshed leaf tobacco includes a plurality of tobacco particle separating units, each including a separation chamber and having a fan system for establishing a generally upward air flow therein. A tobacco particle projecting mechanism is provided in each chamber for projecting, in cooperation with additional air flow provided at the projecting side of the separation chamber, tobacco particles across the upward air flow therein with each having structure for directing tobacco particles in cooperating relation therewith to be projected thereby. Mechanisms receive the lighter particles carried upwardly by the air flow, the heavier particles moving downwardly within each chamber and discharge the particles therefrom. The tobacco particle separating units are mounted in side-by-side relation in a row which includes an initial end unit and a final end unit with the tobacco particle directing structure of the initial end unit arranged to receive a supply of threshed leaf tobacco and the tobacco particle directing structure of the remaining of the plurality of units being directly connected to receive tobacco particles through a tobacco particle opening in the receiving side of the chamber of the preceding unit so that the tobacco particles projected across the chamber of the preceding unit which move across the air flow therein and pass through the opening form a tobacco particle supply directed to an associated projecting mechanism by an associated tobacco particle directing structure.

36 Claims, 4 Drawing Sheets

MODULAR STYLE MULTI-SEPARATOR

The invention relates to apparatus for separating threshed leaf tobacco, and more particularly to apparatus of this type which will improve the separation characteristics while minimizing damage to the lamina particles.

The invention is particularly concerned with the separation of threshed tobacco leaves by air stream separation into (1) lighter particles such as lamina with little or no stem, and (2) heavier particles such as stem with or without attached lamina. Air flotation type separation apparatus is known, and basically includes a separation chamber having opposed sides and a closed fan system for establishing a generally upward flow of air within the chamber between the sides thereof. Successive particles from a supply of threshed leaf tobacco are projected from one side of the chamber across the chamber so that (1) lighter particles are carried upwardly by the airflow within the chamber, and (2) heavier particles move by gravity downwardly through the airflow within the chamber. A discharge system is provided in the upper portion of the chamber for receiving the upwardly carried lighter particles and discharging them from the chamber, and a separate discharge system is provided in the lower portion of the chamber for receiving the heavier particles moving downwardly by gravity and discharging the same from the chamber.

In U.S. Pat. No. 4,465,194, there is disclosed an apparatus of this type in which means is provided for further handling and separating projected particles which travel entirely across the chamber and for effecting a final separation of lighter particles entrained with the particles received in the heavier particle discharge system. The lighter particles separated in the apparatus are frequently subsequently shredded into a form useful in cigarettes.

In the use of apparatus of the type herein contemplated, it is often the case that the heavier particle fraction discharging from the apparatus contains lighter particles clumped therewith, which did not get separated in the operation of the apparatus. Consequently, it is often the practice to set up an intervening power-operated system for delivering the heavier particle discharge from one apparatus to the inlet of a similar apparatus as the threshed leaf tobacco supply thereof. In this way, a better final separation can be achieved. However, due to the additional handling by the intervening power-operated system, it is achieved in a manner which tends to effect damage to the lamina. Thus, in U.S. application Ser. No. 07/804,741, there is disclosed an apparatus capable of cooperating with a similar apparatus without the need to provide a lamina-damaging intervening power-operated system. The apparatus, for separating lighter particles such as lamina containing little or no stem from tobacco particles contained in threshed leaf tobacco, comprises a plurality of tobacco particle separating units. Each of the separating units includes a separation chamber having a pair of opposite sides one of which is a projecting side and one of which is a receiving side and upper and lower ends. A fan system is provided in conjunction with each chamber for establishing a generally upward air flow in the separation chamber from the lower end to the upper end thereof between the opposite sides thereof. A tobacco particle projecting mechanism is in the projecting side of each chamber for projecting tobacco particles across the generally upward air flow in the chamber so that lighter particles are carried upwardly by the air flow within the chamber. A structure is provided for directing tobacco particles into each projecting means to be projected thereby. A mechanism is provided in the upper end of each chamber for receiving the lighter particles projected by the projecting mechanism and carried upwardly by the air flow within the chamber and discharging the lighter particles therefrom. A system is provided to receive the heavier particles projecting by the projecting mechanism moving downwardly within the air flow within the chambers and discharging the heavier particles therefrom. The plurality of tobacco particle separating units are mounted in side-by-side relation in a row which includes an initial end unit and a final end unit with the tobacco particle directing structure of the initial end unit arranged to receive a supply of threshed leaf tobacco and the tobacco particle directing structure of the remaining of the plurality of units being directly connected to receive tobacco particles from a tobacco particle opening in the receiving side of the chamber of the preceding unit so that the tobacco particles projected across the chamber of the preceding unit which move across the air flow therein and pass through the opening form a tobacco particle supply directed to the projecting mechanism of the remaining of the plurality of units.

In utilizing the above-mentioned apparatus, it has been found that under certain circumstances, heavier tobacco particles tend to accumulate at the projecting side of the chamber, thereby, detrimentally effecting the ability of the apparatus to operate effectively. One factor contributing to the tendency for accumulation to occur at the feeding site was that the source of upward air flow was required to pass upwardly through both flights of the foraminous endless conveyor for discharging the heavier particles positioned in the lower end of each separation chamber. In the more recent embodiments of the apparatus, the heavier particle conveyor is inclined upwardly from the projecting side of each separation chamber to the receiving side so that the openings in the endless conveyor were likewise inclined. The result was to give the upward air flow a lateral or horizontal component of movement in a direction toward the projecting side of the chamber which in turn resulted in a tendency to reduce the distance which the projecting mechanism was capable of projecting the particles. Under some input conditions in the initial chamber, enough heavier particles where dropping onto the upwardly inclined operative flight of the heavy particle conveyor that they moved downwardly on the inclined conveyor to a position which tended to create a fluidized accumulation of particles adjacent the projecting mechanism. This fluidizing accumulation tended to build up until blockage occurred. There is, therefore, a need to provide improvements in an apparatus of the type described which will eliminate the aforesaid tendency for particles to accumulate at the projecting side and provide efficient operation under all circumstances.

Accordingly, it is an object of the present invention to provide an apparatus which will fulfill the above-described need. Thus, the present improvements in the tobacco separating apparatus include modifications to the heavier particle conveyor which will ensure vertical flow straight through both conveyor flights. The present improvements also contemplate an arrangement for directing or diverting an auxiliary flow of air from the plenum in the direction of particle projection in association with each particle projecting mechanism. Such an arrangement is useful in ensuring against accumulation occurring at the projecting site for any reason, whether by virtue of the heavier particle conveyor providing a horizontal bias to the upward air flow or not. The present improvements contemplate the inducement of a flow of outside air into each chamber in a position to establish an auxiliary air flow in the direction of particle projection adjacent the initial lower end of the operative flight of the particle conveyor. The present invention contemplates each of the above three improvements as being sufficient in and of itself to eliminate the accumulation tendencies discussed above. Clearly, the invention contemplates the utilization of any two or all three improvements to provide greater assurance in eliminating the tendency of accumulation of the heavier particles in each chamber.

In accordance with the principles of the present invention, the objective is obtained by providing an apparatus for separating lighter particles such as lamina containing little or no stem from tobacco particles contained in threshed leaf tobacco which comprises a plurality of tobacco particle separating units, each including a separation chamber and each having a fan system for establishing a generally upward air flow therein. A tobacco particle projecting mechanism is provided in each chamber for projecting, in cooperation with air flow provided at the projecting side of the separation chamber, tobacco particles across the generally upward air flow therein with each having structure for directing tobacco particles in cooperating relation therewith to be projected thereby. Auxiliary air flow is provided at the projecting side of each chamber to further assist in directing tobacco particles across the generally upward air flow. Mechanisms are provided for receiving the lighter particles carried upwardly by the air flow, the heavier particles moving downwardly within the air flow within each chamber and discharging the particles therefrom. The plurality of tobacco particle separating units are mounted in side-by-side relation in a row which includes an initial end unit and a final end unit with the tobacco particle directing structure of the initial end unit arranged to receive a supply of threshed leaf tobacco and the tobacco particle directing structure of the remaining of the plurality of units being directly connected to receive tobacco particles through a tobacco particle opening in the receiving side of the chamber of the preceding unit so that the tobacco particles projected across the chamber of the preceding unit which move across the air flow therein and pass through the opening form a tobacco particle supply directed to an associated projecting mechanism by an associated tobacco particle directing structure.

The above object and other objects of the present invention will become more apparent during the course of the following detailed description and appended claims.

The invention may best be understood with reference to the accompanying drawings wherein an illustrative embodiment is shown.

IN THE DRAWINGS

Figure 1:
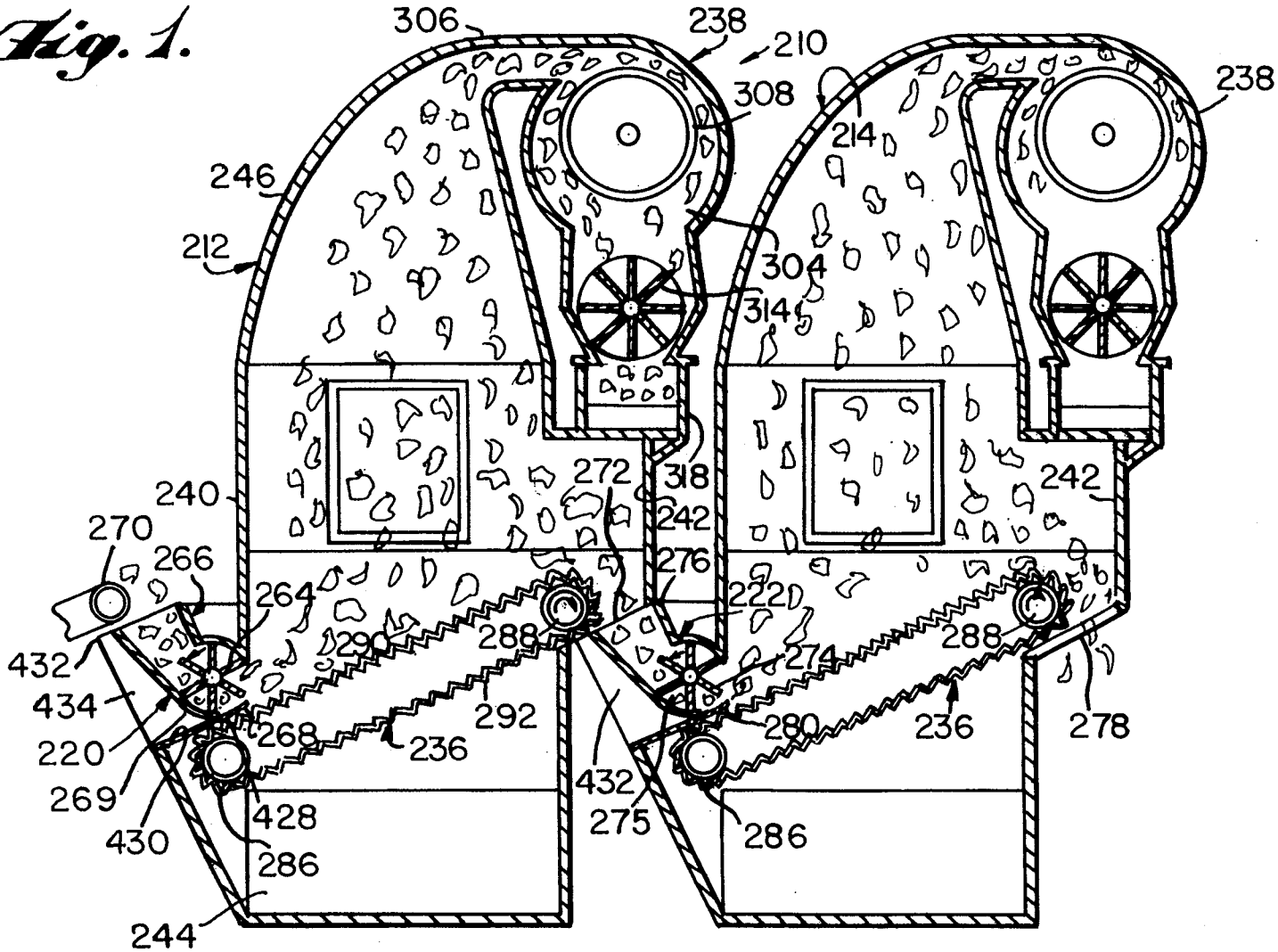
FIG. 1 is a schematic sectional view of an embodiment of an apparatus embodying the principles of the present invention.

Referring now more particularly to FIGS. 1–4 of the drawings, there is shown therein an apparatus, generally indicated at 210, for separating threshed leaf tobacco into (1) lighter particles such as lamina containing little or no stem, and (2) heavier particles such as lamina with attached stem or naked stems. In the illustrated embodiment, two identical separation devices are provided, an initial end separation device 212 and a final end separation device 214. It can be appreciated that each device is capable of operating alone or in side-by-side relation with a similar device or chamber. Thus, additional separation chambers may be provided if desired. It will be understood that, since the separation devices 212 and 214 are similar, a description of separation device 212 will be sufficient to provide an understanding of the construction and operation of the separation device 214. Accordingly, the same reference numerals utilized in the description of separation device 212 will be applied to separation device 214. A fan circulating system, generally indicated at 218, is associated with each separation chamber for establishing a generally upward flow of air within the associated separation chamber. The initial end chamber 212 has associated with a projecting side thereof a threshed leaf tobacco projecting mechanism, generally indicated at 220 which is operable to project threshed leaf tobacco from the projecting side of the chamber toward an opposite receiving side thereof, so that (1) a portion of the lighter particles is carried upwardly by the flow of air within the initial end chamber, (2) a portion of the heavy particles moves downwardly through the flow of air within the initial end chamber, and (3) the remaining particles pass to the opposite receiving side of the initial end chamber 212.

The final end chamber 214 includes a similar threshed leaf tobacco projecting mechanism, generally indicated at 222, for receiving the remaining particles which pass to the opposite receiving side of the initial end chamber 212, and projecting the same into the final end chamber 214 to be acted upon by the upward flow of air therein in a similar manner.

A heavier particle receiving and discharging system, generally indicated at 236, is provided in the lower end portion of each separation chamber 212, 214, for receiving the heavier particles therefrom. A lighter particle receiving and discharging system is also provided. However, as shown, the system consists of two lighter particle receiving and discharging mechanisms 238 of generally identical construction, in the upper end portions of the separation chambers 212, and 214 respectively, for receiving the lighter particles carried upwardly by the flow of air within each successive separation chamber and discharging the lighter particles therefrom.

The separation chambers may be formed of any desirable construction. Preferably, they are of identical construction. In the drawings, the chambers are schematically illustrated to be formed of sheet metal. It will be understood that a rigid framework for retaining the sheet metal (not shown) normally would be provided. As shown, each chamber is of generally rectangular configuration, including a projecting side wall 240, and an opposite receiving side wall 242, with a lower end portion 244 being somewhat enlarged, and an upper end portion 246 being generally of upwardly tapering design configuration which aids in separating the lighter particles by increasing the velocity of the upward air flow as it passes therethrough.

The fan circulating or air flow establishing system 218 for each chamber may assume any desired configuration. As shown, each system includes a rotary centrifugal fan blade assembly 248 suitably journalled for rotational movement, by a variable speed motor assembly 250 about a horizontal axis within a fan housing 252 of conventional centrifugal fan configuration, that is, the fan housing 252 is in the form of side walls interconnected peripherally by an arcuate peripheral wall which extends somewhat less than 360° so as to provide for a tangential discharge 254 which constitutes the pressure side of the fan blade assembly 248. Regulating dampers may be installed in the discharge duct to control flow instead of fitting a variable speed motor.

Figure 4:
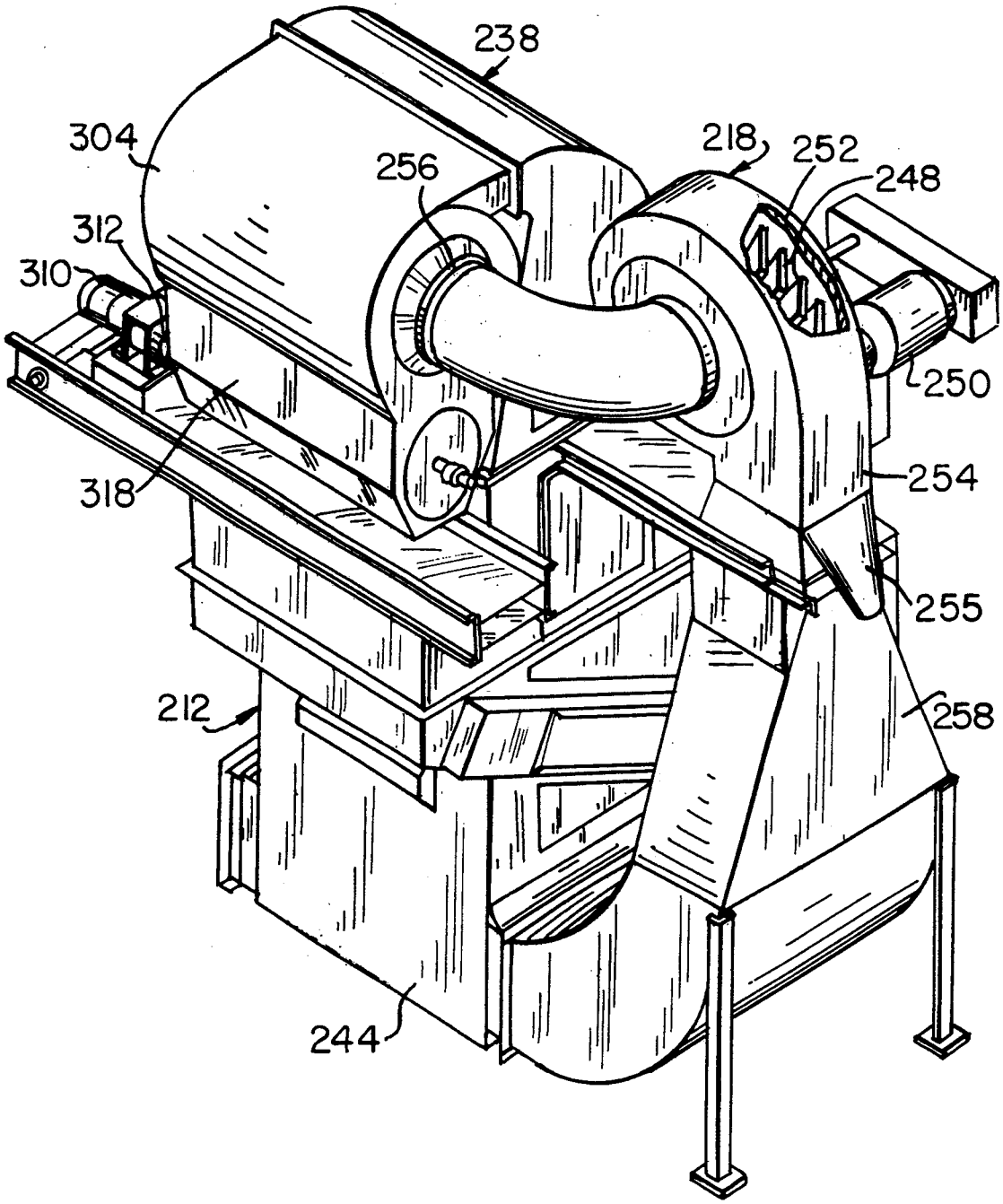
FIG. 4 is a perspective view of a separation chamber provided in accordance with the principles of the present invention.

As best shown in FIG. 4, the tangential discharge 254 includes a filtered scoop exit 255 to allow a certain amount of air to pass into the atmosphere preferably after being filtered. Thus, the scoop exit 255 may bleed-off about 10% of the recirculating air. The hollow central portion of each fan blade assembly 248 communicates directly with an inlet 256 of frustoconical design, one end of which is secured to one side of the fan housing 252 in interior communicating relation therewith, with the other end communicating with the separation chamber through the lighter particle receiving and discharging mechanism 238.

The tangential discharge 254 of each fan blade assembly 248 is connected with a generally elongated angular duct section 258, the lower end of which curves inwardly and communicates interiorly with the lower end portion 244 of the associated separation chamber. The lower end portion 244 is simply a plenum chamber. The fan assembly 248 is disposed 90 degrees with respect to the separation chamber which enables air to be blown downward into plenum chamber 244 from a central position, thus evenly distributing the downward air flow prior to entering the plenum chamber.

The threshed leaf tobacco projecting mechanism 220 which is utilized in the projecting side wall 240 of the initial end chamber 212 is illustrated as including a paddle wheel type winnower assembly 264, which is rotatable about a transverse horizontal axis and suitably power-driven by a variable speed motor (not shown). It will be understood that other types of arrangements may be utilized such as described in U.S. Pat. Nos. 4,475,562 and 5,205,415, the disclosures of which are hereby incorporated hereinto by this reference.

As shown, the projecting side wall 240 has an inlet opening provided therein which cooperates exteriorly with a shroud structure 266 which leads to and is disposed in cooperating relation with the winnower assembly 264 so as to direct a tobacco particle supply into the winnower assembly 264 to be projected thereby. As shown, the shroud structure 266 is mounted in cooperating relation with the periphery of the winnower assembly 264 and a vane 268 is adjustably mounted to a lower portion 269 of shroud 266 and about a horizontally extending axis in a position tangentially outwardly of the lower periphery of the winnower assembly 264 so that by adjusting the angle of the vane 268, the direction within the initial end chamber 212 across which the winnower assembly 264 projects the threshed leaf tobacco can be varied.

A suitable supply of threshed leaf tobacco, shown schematically at 270, is fed to the shroud structure 266 so that successive particles are picked up by the winnower assembly 264 and projected into the initial end chamber 212 for movement across the generally upward flow of air therein. The flow rate of the upward flow of air, which is separately controlled by the variable speed motor 250 associated with chamber 212, is such that lighter particles, such as lamina containing little or no stem, are carried upwardly by the air stream within the separation chamber, while heavier particles, such as lamina with attached stem or naked stems, move downwardly through the flow of air by gravity within the initial end chamber 212. In addition, a remaining portion of the particles moves to the opposite receiving side wall 242 where the particles pass through an opening 272 therein and are directed to the threshed leaf tobacco projecting mechanism 222 associated with the final end chamber 214.

The projecting mechanism 222 of the final end chamber 214 is identical to that of the initial end chamber 212 and has a shroud structure 276 which extends in enclosing relation from the opening 272 in the receiving side wall 242 of the final end chamber 214 in cooperating relation with respect to the winnower assembly 274. There is also provided a vane 280 which is movable with respect to lower shroud portion 275 and about a horizontally extending axis parallel with the axis of the winnower. The vane 280 and variable speed drive for the winnower 274 can be adjusted to adjust the direction and velocity which the remaining particles are projected into the associated chamber 214 so that as the particles move across the generally upward flow of air therein, the lighter particles will be carried upwardly by the flow of air, which is separately controlled as before, into the upper portion of the chamber, and the heavier particles will be moved downwardly by gravity through the flow of air into the lower portion of the separation chamber, while a remaining portion of the particles will move across the chamber to the opposite side wall 242 which likewise is provided with a similar opening 278 for discharging the particles from the final end chamber 214.

Figure 2:
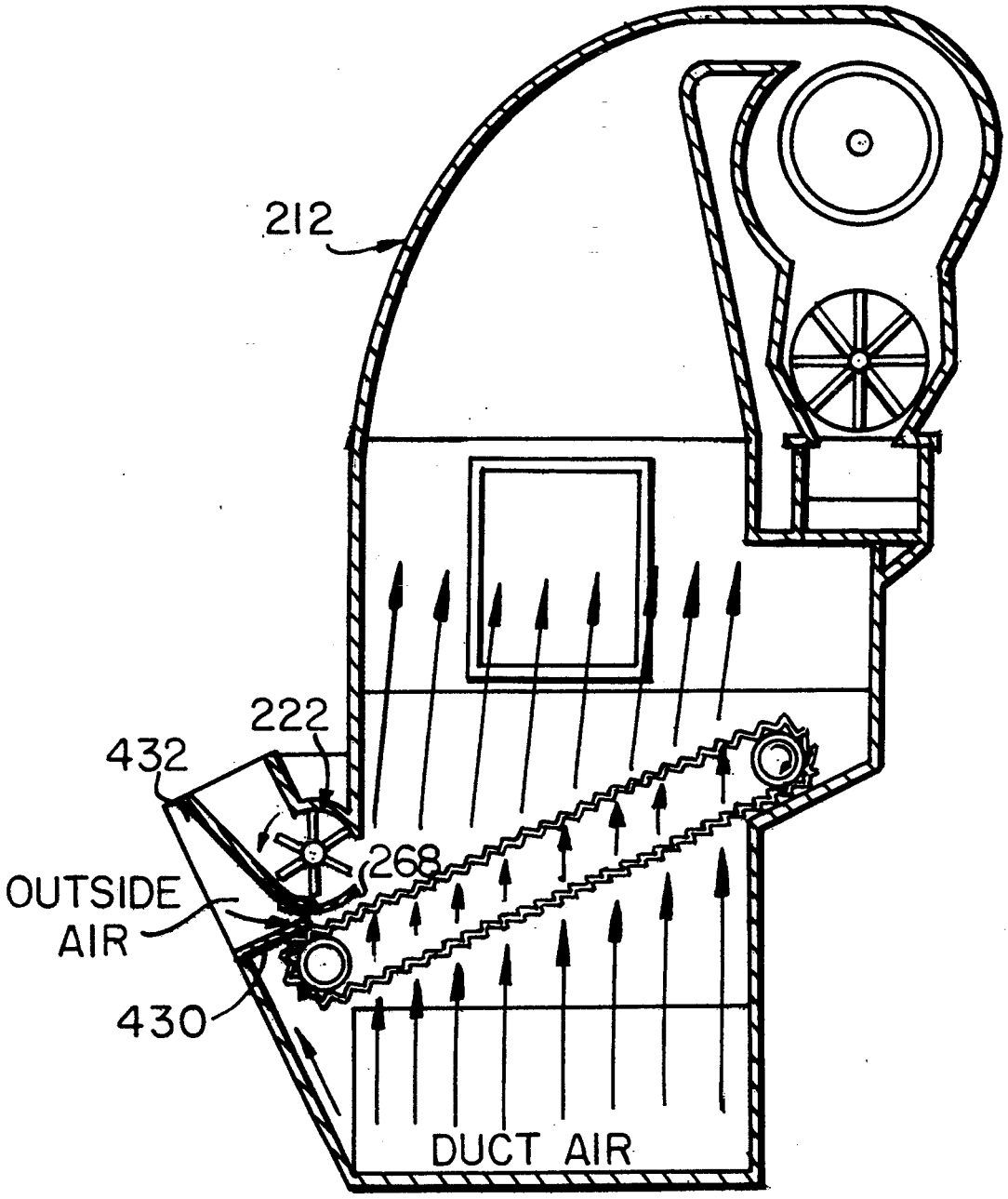
FIG. 2 is a schematic illustration of a separation chamber of the apparatus of FIG. 1 showing the direction of air flow.
Figure 3:
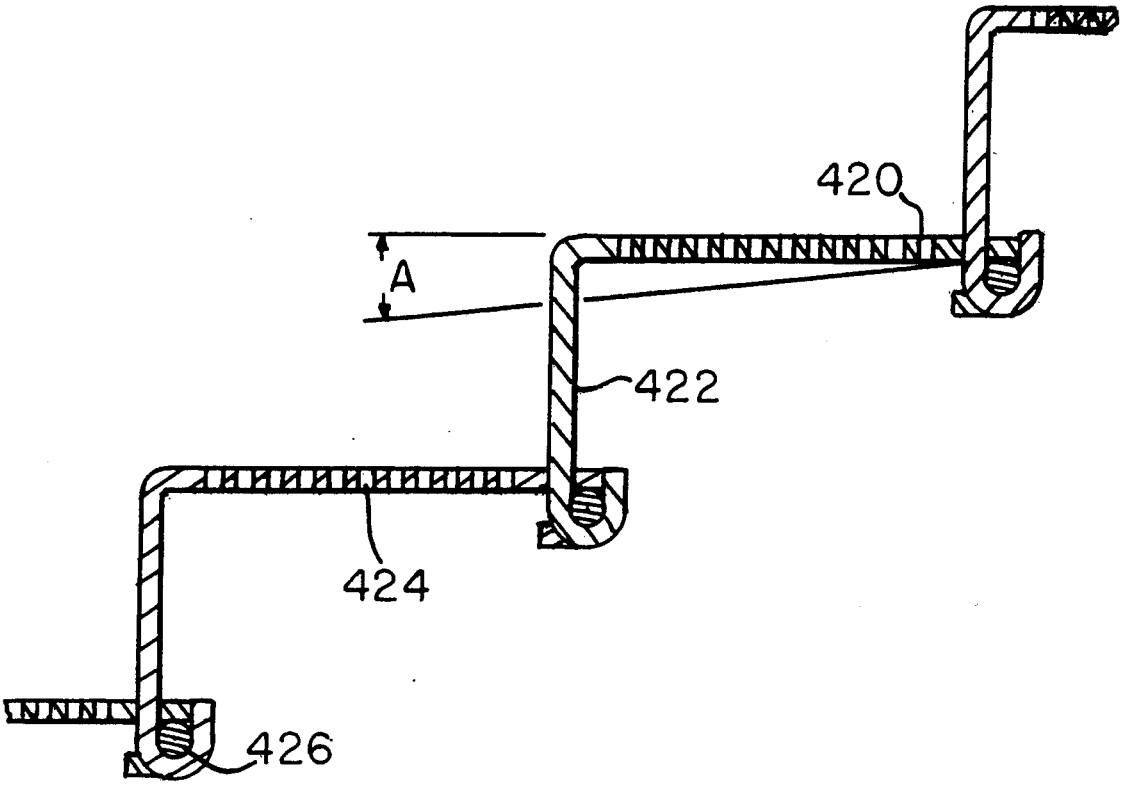
FIG. 3 is an enlarged partial sectional view of the endless foraminous conveyor of the apparatus of FIG. 1.

Each chamber 212, 214 includes a heavier particle receiving and discharging system 236 which comprises essentially an endless perforated or foraminous conveyor assembly which may be of any conventional design. The conveyor assemblies of each chamber are identical, thus, only one will be described in detail. The conveyor assembly includes an initial end roller 286 mounted in the lower end portion 244 of the initial end chamber 212 at a position adjacent the projecting side wall 240 thereof, below the projecting mechanism 220. A final roller 288 is disposed in a position extending substantially to receiving wall 242 and disposed in a plane above roller 286 so that the conveyor assembly extends upwardly within chamber 212. The endless perforated or foraminous conveyor assembly 236 includes an endless foraminous belt providing upper operative flight 290 extending within the lower portion of chamber 212 from the roller 286 to the roller 288, and a parallel lower return flight 292 extending from the roller 288 to the roller 286. When tobacco particles are projected from the projecting mechanism 220 and into the chamber 212, heavier particles tend to fall onto the operative flight of the conveyor assembly 236. The air within the chamber fluidizes the heavier particles. However, since the conveyor is upwardly inclined, the upward air flow exhibited a lateral component of movement in a direction toward the projecting side of the chamber which in turn tended to cause the heavier particles to move down the conveyer and gather near the projecting mechanism, thus reducing the efficiency of the device. Thus, to reduce the tendency of the heavier particles from moving down the inclined conveyor, the conveyor assembly 236 is of step-like configuration having legs 420, disposed at about a five degree incline with respect to horizontal as shown at A in FIG. 3, and vertical legs 422. The horizontal legs are approximately 2 inches in length and include a plurality of perforations 424 which permit air to pass substantially vertically therethrough (FIG. 3). Each vertical leg is preferably solid and integrally formed with a horizontal leg. The horizontal legs are coupled to the vertical legs at couplings 426, such as, for example, piano hinges. Thus, due to the configuration of the conveyor assembly, air flows substantially vertically upward through the perforations of the horizontal legs, first through the lower flight, then through the upper operative flight of the conveyor providing an effective fluidizing effect (FIG. 2). The endless foraminous conveyor 236 includes a suitable driving motor (not shown), so that the upper operative flight 290 moves from the roller 286 toward the roller 288, and the return flight moves in the opposite direction.

As shown in FIG. 1, the initial end roller 286 is mounted in the lower end portion 244 of the initial end chamber 212 below the projecting mechanism 220 so as to define a space 428 therebetween. A deflector 430 is mounted so as to extend within the space 428 for directing air flow. An air inlet passage 432 is defined by sidewalls 434, between the deflector 430 and a peripheral portion of the shroud structure 266 of the projecting mechanism, for introducing auxiliary external air into chamber 212. Thus, pressure conditions are established in the chamber to induce air flow. In that regard, in each chamber, the fan circulating system 218 discharges from the chamber approximately 10% of air at the pressure side of the fan, which causes a negative pressure at the suction side of the fan. Because, air inlet passage 432 is opened, the auxiliary external air is induced to flow into the chamber to equalize the pressure therein. As tobacco particles enter the chamber via the projecting means 220, the auxiliary external air flowing through inlet passage 432 at the projection side of the chamber aids in directing the heavier particles across the upward air flow in chamber 212 (FIG. 2). In the illustrated embodiment, air is permitted to flow around the initial end roller 286 and past the underside of the deflector 430 which further aids in directing heavier particles across the upward air flow in chamber 212. The diverted air flow and/or the external air flow prevents accumulation of the heavier particles in the chamber near the initial end roller 286, since the air flow directs the particles across the upward air flow in the projecting direction. As the heavier particles are directed across the upward air flow, the perforations 424 in the horizontal legs of the conveyor assembly ensure that the passage of air through the operative flight is near vertical or has a slight component in the direction of the receiving side of the separation chamber 212, thus providing a fluidizing effect.

The lighter particle receiving and discharging system could be the same as the system disclosed in U.S. Pat. No. 5,099,863, the disclosure of which is hereby incorporated hereinto by this reference. However, FIGS. 1–4 illustrate an alternative system in the form of two separate mechanisms 238 such as known screening separators or tangential separators. As shown, each mechanism 238 includes a screening chamber 304 of generally cylindrical construction having a narrow Venturi-like inlet 306 which extends tangentially from the extremity of the upper end 246 of the associated chamber into the upper end of the screening chamber 304. Rotatably mounted in the screening chamber is a cylindrical screen assembly 308, one interior end of which is communicated through an associated screening chamber end wall with the suction side of the associated frustoconical fan inlet 256. In this way, the upward flow of air in each chamber is caused to flow through the tangential inlet 306 at upper end 246, into the screening chamber 304, through the rotary screen assembly 308 and then axially through the fan inlet 256 to be recirculated.

The screening separator acts like a horizontal cyclone. The centrifugal force causes most of the solid particles to hug the peripheral wall and discharge through the airlock. Only light particles which remain in suspension contact the rotary screen.

The lighter tobacco particles carried by the air flow into the screening chamber 304 are prevented from being recirculated with the air by the cylindrical screen assembly 308. The screen assembly 308 is rotated as by a motor 310 and a suitable motion transmitting assembly 312 at a speed sufficient to cause any tobacco particles which engage the periphery of the screen assembly 308 by virtue of the air flow to be thrown by centrifugal action therefrom to the interior periphery of the screening chamber wall which directs them downwardly to a rotary plug or particle discharging mechanism 314 rotatably mounted in the lower portion of the screening chamber.

The rotary discharging mechanism which is driven by a suitable motion transmitting assembly by the motor 310 serves the dual function of preventing air suction from the exterior of the screening chamber 308 while at the same time allowing and, indeed, positively assisting the tobacco particles directed downwardly in the screening chamber 308 to exit exteriorly therefrom. As shown, a conveyor assembly 318 receives the lighter tobacco particles discharged from the screening chamber 308 and conveys them to a point of further use or handling.

With reference to FIG. 1, it can be seen that some heavier particles which fall by gravity through the upward flow of air in each of the separation chambers will come to rest on the upwardly facing surface of the upper operative flight 290 of the endless foraminous conveyor assembly 236. It will be noted that most of the heavier particles will be conveyed upward and discharged as they move with the upper operative flight 290 over the roller 288. Thus, the heavier particles are discharged downwardly through opening 272 through the shroud structure 276 and into the projecting mechanism 222 of the final end chamber 214. The discharged particles enter chamber 214 due to the cooperation of the projecting mechanism 222 and external air flow through duct 432, whereby lighter particles previously trapped or shadowed by heavier particles may have another chance of moving upward from the fluidizing effect above the conveyor 236. Conveyor assembly 236 of the final end chamber 214 discharges the heavier particles downwardly through a discharge opening 278.

It can be appreciated the improvements discussed above can alone, or in conjunction, prevent accumulation of the heavier particles at the projecting side of each chamber. Thus, diverting the upward air flow around the initial end roller 286 and past the underside of the deflector 430 may be done in conjunction with, or separate from, providing external air flow into the chambers and providing the stepped conveyor. Further, external air may be induced into each chamber with or without diverting the upward air flow, or with or without providing a stepped conveyor.

Although the invention has been described with reference to separating the lighter particles of threshed leaf tobacco leaves from heavier particles thereof, it can be appreciated that the apparatus may be employed to separate various particle mixtures. For example, tobacco from cigarettes and/or cigars that are not suitable for sale may be salvaged and repackaged. Thus, a mixture of tobacco particles and paper may be supplied to the apparatus to separate the lighter paper particles from the heavier tobacco particles. It may also be desired to separate lighter, single leaves from heavier leaves which may be in a padded condition. Further, the apparatus may be employed to separate heavy, foreign materials, such as stones and sand, from tobacco or other lighter particles, or, in fact, any mixture of particles which have different surface area to weight ratios.

Any United States patent applications or patents mentioned or cited hereinabove are hereby incorporated by reference into the present specification.

It will be seen that the objects of this invention have been fully and effectively accomplished. It will be realized that the foregoing preferred specific embodiment has been shown and described for the purpose of this invention and is subject to change without departure from such principles. This invention includes all modifications encompassed within the spirit and scope of the following claims.

What is claimed is:

1. Apparatus for separating lighter particles containing little or no stem from tobacco particles contained in threshed leaf tobacco which comprises a plurality of tobacco particle separating units, each of said separating units including walls defining a separation chamber, the chamber having a pair of opposite sides one of which is a projecting side and one of which is a receiving side and upper and lower ends, a fan system for establishing a generally upward air flow in said separation chamber from the lower end to the upper end thereof between the opposite sides thereof, a tobacco particle projector in the projecting side of said chamber for projecting tobacco particles across the generally upward air flow in said chamber so that lighter particles are carried upwardly by the air flow within said chamber, structure for directing tobacco particles into cooperating relation with said projector to be projected thereby, structure for establishing air flow so as to cooperate with said projector to direct the tobacco particles across the generally upward air flow, a mechanism in the upper end of said chamber for receiving the lighter particles projected by said projector carried upwardly by the air flow within said chamber and discharging said lighter particles therefrom, and a mechanism for receiving the heavier particles projected by said projector moving downwardly within the air flow within said chamber and discharging the heavier particles therefrom, said plurality of tobacco particle separating units being mounted in side-by-side relation in a row for continuous movement of particles therethrough from an initial end unit downstream to a final end unit with the tobacco particle directing structure of the initial end unit arranged to receive a supply of threshed leaf tobacco and the tobacco particle directing structure of each unit downstream from said initial unit being directly connected to receive tobacco particles from a tobacco particle receiving opening in the receiving side of the chamber of the preceding unit so that the tobacco particles, projected across the chamber of the preceding unit which move across the upward air flow therein and pass through an associated tobacco particle receiving opening, form a tobacco particle supply directed to an associated projector by the associated tobacco particle directing structure, wherein said heavier particle receiving and discharging mechanism comprises an endless foraminous conveyor including an operative flight extending upwardly from the projecting side of said chamber to the receiving side thereof, said operative flight being constructed and arranged to move from the projecting side of said chamber to the receiving side thereof at a location which causes the generally upward air flow in the chamber to flow upwardly through the operative flight moving therethrough, the endless foraminous conveyor of the chamber of said final end unit discharging through a discharge opening, the endless foraminous conveyor of each unit upstream from said final end unit discharging into a tobacco particle receiving opening associated therewith so that the heavier particles discharged into the associated tobacco particle receiving opening form another tobacco particle supply directed to the projector of the adjacent downstream unit.

2. Apparatus as defined in claim 1 wherein said plurality of tobacco particle separating units includes two units of identical construction.

3. Apparatus as defined in claim 2 wherein the row of side-by-side units extends horizontally at the same horizontal level.

4. Apparatus as defined in claim 1, wherein said endless foraminous conveyor has a stepped construction defining a plurality of horizontal and vertical legs, said horizontal legs including a plurality of perforations therein for directing said upward air flow in a substantially vertical direction.

5. Apparatus as defined in claim 1 wherein a portion of each said endless foraminous conveyor at said projecting side of each said chamber is spaced from an associated said projector.

6. Apparatus as defined in claim 5 wherein said structure for establishing air flow cooperating with an associated projector includes an external air inlet passage disposed at the projecting side of an associated chamber for introducing external air between the associated said projector and said portion of an associated said endless foraminous conveyor.

7. Apparatus as defined in claim 5 wherein said structure for establishing air flow cooperating with an associated projector includes a diverter disposed at the projecting side of an associated separation chamber for diverting a portion of the upward air flow to flow between the associated projector and said portion of an associated said endless foraminous conveyor.

8. Apparatus as defined in claim 1 wherein said structure for establishing air flow cooperating with an associated projector includes an external air inlet passage disposed at the projecting side of an associated chamber.

9. Apparatus ass defined in claim 8 wherein said fan system is adapted to create negative pressure conditions in an associated separation chamber so that opening an associated said external air inlet passage causes external air to flow into the associated separation chamber.

10. Apparatus as defined in claim 1 wherein said structure for establishing air flow cooperating with an associated projector includes a diverter disposed at the projecting side of the separation chamber for diverting a portion of the upward air flow to cooperate with an associated said projector to project the tobacco particles across the upward air flow.

11. Apparatus as defined in claim 1 wherein each said tobacco projector includes a power-driven rotary paddle wheel winnower and each said tobacco particle directing structure includes a shroud structure extending in cooperating relation with an associated said winnower.

12. Apparatus as defined in claim 1 wherein each said lighter particle receiving and discharging mechanism includes a screening chamber communicating interiorly at its upper end with a restricted inlet extending tangentially from the upper end of each chamber, a power driven cylindrical screen assembly rotatably mounted in each screening chamber and a power driven discharge mechanism in each screening chamber below each screen assembly, said fan system including a power driven fan assembly for each chamber having a suction side communicated with an interior end of an associated cylindrical screen assembly through the screening chamber thereof.

13. Apparatus as defined in claim 1 wherein each said fan system is disposed in a central position with respect to an associated separation chamber so that air established thereby is evenly distributed across the lower end of the associated separation chamber so that the generally upward air flow is evenly distributed within the associated separation chamber.

14. Apparatus for separating lighter particles containing little or no stem from tobacco particles contained in threshed leaf tobacco which comprises walls defining a separation chamber, the chamber having a pair of opposite sides one of which is a projecting side and one of which is a receiving side and upper and lower ends, a fan system for establishing a generally upward air flow in said separation chamber from the lower end to the upper end thereof between the opposite sides thereof, a tobacco particle projector in the projecting side of said chamber for projecting tobacco particles across the generally upward air flow in said chamber so that lighter particles are carried upwardly by the air flow within said chamber, structure for establishing air flow so as to cooperate with said projector to direct the tobacco particles across the generally upward air flow, a mechanism in the upper end of said chamber for receiving the lighter particles projected by said projector carried upwardly by the air flow within said chamber and discharging said lighter particles therefrom, and a mechanism for receiving the heavier particles projected by said projector moving downwardly within the air flow within said chamber and discharging the heavier particles therefrom, wherein said heavier particle receiving and discharging mechanism comprises an endless foraminous conveyor including an operative flight extending upwardly from the projecting side of said chamber to the receiving side thereof, said operative flight being constructed and arranged to move from the projecting side of said chamber to the receiving side location which causes the generally upward air flow in the chamber to flow upwardly through the operative flight moving therethrough, the endless foraminous conveyor discharging heavier particles from said chamber through a discharge opening.

15. Apparatus as defined in claim 14 wherein said endless foraminous conveyor has a stepped construction defining a plurality of horizontal and vertical legs, said horizontal legs including a plurality of perforations therein for directing said upward air flow in a substantially vertical direction.

16. Apparatus as defined in claim 14 wherein said structure for establishing air flow cooperating with the projector includes an external air inlet passage disposed at the projecting side of the chamber.

17. Apparatus as defined in claim 16 wherein said fan system is adapted to create negative pressure conditions in said separation chamber so that opening said external air inlet passage causes external air to flow into said separation chamber.

18. Apparatus as defined in claim 14 wherein said structure for establishing air flow cooperating with the projector includes a diverter disposed at the projecting side of the separation chamber for diverting a portion of the upward air flow to cooperate with said projector to project the tobacco particles across the upward air flow.

19. Apparatus as defined in claim 14 wherein said projector includes a power-driven rotary paddle wheel winnower and said tobacco particle directing structure includes a shroud structure extending in cooperating relation with said winnower.

20. Apparatus as defined in claim 14 wherein said lighter particle receiving and discharging mechanism includes a screening chamber communicating interiorly at its upper end with a restricted inlet extending tangentially from the upper end of said chamber, a power driven cylindrical screen assembly rotatably mounted in said screening chamber and a power driven discharge mechanism in said screening chamber below said screen assembly, said fan system including a power driven fan assembly having a suction side communicated with an interior end of the cylindrical screen assembly through the screening chamber thereof.

21. Apparatus for separating lighter particles containing little or no stem from tobacco particles contained in threshed leaf tobacco which comprises a plurality of tobacco particle separating units, each of said separating units including walls defining a separation chamber having a pair of opposite sides one of which is a projecting side and one of which is a receiving side and upper and lower ends, a fan system for establishing a generally upward air flow in said separation chamber from the lower end to the upper end thereof between the opposite sides thereof, a tobacco particle projector in the projecting side of said chamber for projecting tobacco particles across the generally upward air flow in said chamber so that lighter particles are carried upwardly by the air flow within said chamber, structure for directing tobacco particles into cooperating relation with said projector to be projected thereby, a mechanism in the upper end of said chamber for receiving the lighter particles projected by said projector carried upwardly by the air flow within said chamber and discharging said lighter particles therefrom, and a mechanism for receiving the heavier particles projected by said projector moving downwardly within the air flow within said chamber and discharging the heavier particles therefrom, said heavier particle receiving and discharging mechanism including an endless foraminous conveyor having a stepped operative flight, said plurality of tobacco particle separating units being mounted in side-by-side relation in a row for continuous movement of particles therethrough from an initial end unit downstream to a final end unit with the tobacco particle directing structure of the initial end unit arranged to receive a supply of threshed leaf tobacco and the tobacco particle directing structure of each unit downstream from said initial unit being directly connected to receive tobacco particles from a tobacco particle receiving opening in the receiving side of the chamber of the preceding unit so that the tobacco particles projected across the chamber of the preceding unit which move across the upward air flow therein and pass through an associated tobacco particle receiving opening form a tobacco particle supply directed to an associated projector by the associated tobacco particle directing structure, wherein each said endless foraminous conveyor extends upwardly from the projecting side of an associated chamber to the receiving side thereof, said operative flight being constructed and arranged to move from the projecting side of said chamber to the receiving side thereof at a location which causes the generally upward air flow in the chamber to flow upwardly through the operative flight moving therethrough, the endless foraminous conveyor of the chamber of said final end unit discharging through a discharge opening, the endless foraminous conveyor of each unit upstream from said final end unit discharging into a tobacco particle receiving opening associated therewith so that the heavier particles discharged into the associated tobacco particle receiving opening form another tobacco particle supply directed to the projector of the adjacent downstream unit, and wherein said stepped operative flight of each said conveyor includes a plurality of horizontal and vertical legs, said horizontal legs including a plurality of perforations therein for directing said generally upward air flow in a substantially vertical direction within said chamber.

22. Apparatus as defined in claim 21 wherein said plurality of tobacco particle separating units includes at least two units of identical construction.

23. Apparatus as defined in claim 22 wherein the row of side-by-side units extends horizontally at the same horizontal level.

24. Apparatus for separating lighter particles containing little or no stem from tobacco particles contained in threshed leaf tobacco which comprises walls defining a separation chamber having a pair of opposite sides one of which is a projecting side and one of which is a receiving side and upper and lower ends, a fan system for establishing a generally upward air flow in said separation chamber from the lower end to the upper end thereof between the opposite sides thereof, a tobacco particle projector in the projecting side of said chamber for projecting tobacco particles across the generally upward air flow in said chamber so that lighter particles are carried upwardly by the air flow within said chamber, a mechanism in the upper end of said chamber for receiving the lighter particles projected by said projector carried upwardly by the air flow within said chamber and discharging said lighter particles therefrom, and a mechanism for receiving the heavier particles projected by said projector moving downwardly within the air flow within said chamber and discharging the heavier particles therefrom, said heavier particle receiving and discharging mechanism including an endless foraminous conveyor having a stepped operative flight, wherein said endless foraminous conveyor extends upwardly from the projecting side of said chamber to the receiving side thereof, said operative flight being constructed and arranged to move from the projecting side of said chamber to the receiving side thereof at a location which causes the generally upward air flow in the chamber to flow upwardly through the operative flight moving therethrough, the endless foraminous conveyor discharging heavier particles from said chamber through a discharge opening, and wherein said stepped operative flight of said conveyor comprises a plurality of horizontal and vertical legs, said horizontal legs including a plurality of perforations therein for directing said generally upward air flow in a substantially vertical direction within said chamber.

25. Apparatus as defined in claim 24 wherein said endless foraminous conveyor extends from the projecting side of said chamber to the receiving side thereof, the endless foraminous conveyor discharging heavier particles from said chamber through a discharge opening.

26. Apparatus as defined in claim 24 wherein said fan system is disposed in a central position with respect to said separation chamber so that air established thereby is evenly distributed across the lower end of said separation chamber so that the generally upward air flow is evenly distributed within the separation chamber.

27. A method of separating lighter particles from heavier particles in a mixture thereof utilizing a separation chamber for continuous movement of particles therethrough, said chamber having (1) a pair of opposite sides one of which is a projecting side and one of which is a receiving side, said projecting side of said chamber having an inlet opening for receiving side of said chamber having an outlet opening, (2) an extent of an operative flight of a foraminous conveyor extending upwardly therethrough from the projecting side to the receiving side thereof and (3) an air inlet for introducing auxiliary external air into said chamber from the projecting side thereof, said method comprising the steps of establishing a generally upward air flow in said chamber between the opposite sides thereof upwardly through the extent of the operative flight therein, establishing pressure conditions in said chamber in such a manner as to induce auxiliary external air flow through said air inlet from the projecting side thereof toward the receiving side thereof, projecting particles from the projecting side of said chamber across the generally upward air flow therein so that lighter particles are carried upwardly by the air flow in said chamber and particles including heavier particles move downwardly through the generally upward air flow in each chamber, the particles projected from the projecting side of said chamber being the lighter and heavier particles of the mixture which are directed by said auxiliary external air flow into the generally upward air flow in said chamber, causing some of the particles projected from the projecting side of said chamber to reach the receiving side thereof and to pass through the outlet opening therein to be subsequently processed, receiving the lighter particles carried upwardly by the air flow within said chamber and moving the same in such a way as to enable them to discharge from said chamber, and receiving the particles including heavier particles which move downwardly within the generally upward air flow in said chamber on the extent of the operative flight and moving the same in such a way as to enable them to be discharged into the outlet opening in the receiving side of said chamber to be subsequently processed.

28. The method as defined in claim 27 wherein said mixture comprises threshed leaf tobacco.

29. The method as defined in claim 27 wherein said inlet opening and said outlet opening are constructed and arranged such that the separation chamber can be mounted in side by side relation to a similar separation chamber having a similar inlet such that the particles which pass through the outlet opening of said separation chamber move through the similar inlet of the similar separation device.

30. The method as defined in claim 27 wherein said generally upward air flow is established by a fan system and said step of establishing pressure conditions in said chamber includes constructing and arranging said fan system to create negative pressure conditions in said chamber such that external air flows through said air into said chamber to direct the particles projected from the projecting side of each chamber across the generally upward air flow.

31. A method of separating lighter particles from heavier particles in a mixture thereof utilizing a separation chamber for continuous movement of particles therethrough, said chamber having (1) a pair of opposite sides one of which is a projecting side and one of which is a receiving side, said projecting side of said chamber having an inlet opening for receiving the lighter and heavier particles of the mixture with the receiving side of said chamber having an outlet opening, and (2) an extent of an operative flight of a foraminous conveyor extending upwardly therethrough from the projecting side to the receiving side thereof, said method comprising the steps of establishing a generally upward air flow in said chamber between the opposite sides thereof upwardly through the extent of the operative flight therein, diverting a portion of said generally upward air flow in such a manner such that the diverted portion of said upward air flow is directed from the projecting side of said chamber toward the receiving side thereof, projecting particles from the projecting side of said chamber across the generally upward air flow therein so that lighter particles are carried upwardly by the air flow in said chamber and particles including heavier particles move downwardly through the generally upward air flow in each chamber, the particles projected from the projecting side of said chamber being the lighter and heavier particles of the mixture which are directed by the diverted portion of said upward air flow into the generally upward air flow in said chamber, causing some of the particles projected from the projecting side of said chamber to reach the receiving side thereof and to pass through the outlet opening therein to be subsequently processed, receiving the lighter particles carried upwardly by the air flow within said chamber and moving the same in such a way as to enable them to discharge from said chamber, and receiving the particles including heavier particles which move downwardly within the generally upward air flow in said chamber on the extent of the operative flight and moving the same in such a way as to enable them to be discharged into the outlet opening in the receiving side of said chamber to be subsequently processed.

32. The method as defined in claim 31 wherein said mixture comprises threshed leaf tobacco.

33. The method as defined in claim 31 wherein said inlet opening and said outlet opening are constructed and arranged such that the separation chamber can be mounted in side by side relation to a similar separation chamber having a similar inlet such that the particles which pass through the outlet opening of said separation chamber move through the similar inlet of the similar separation device.

34. A method of separating lighter particles from heavier particles in a mixture thereof utilizing a separation chamber for continuous movement of particles therethrough, said chamber having (1) a pair of opposite sides one of which is a projecting side and one of which is a receiving side, said projecting side of said chamber having an inlet opening for receiving the lighter and heavier particles of the mixture with the receiving side of said chamber having an outlet opening, and (2) an extent of a stepped operative flight of a foraminous conveyor extending upwardly therethrough from the projecting side to the receiving side thereof, said method comprising the steps of establishing a generally upward air flow in said chamber between the opposite sides thereof upwardly through the extent of the stepped operative flight therein such that the generally upward air flow has a substantially vertical component after passing through said stepped operative flight, projecting particles from the projecting side of said chamber across the generally upward air flow therein so that lighter particles are carried upwardly by the air flow in said chamber and particles including heavier particles move downwardly through the generally upward air flow in each chamber, the particles projected from the projecting side of said chamber being the lighter and heavier particles of the mixture, causing some of the particles projected from the projecting side of said chamber to reach the receiving side thereof and to pass through the outlet opening therein to be subsequently processed, receiving the lighter particles carried upwardly by the air flow within said chamber and moving the same in such a way as to enable them to discharge from said chamber, and receiving the particles including heavier particles which move downwardly within the generally upward air flow in said chamber on the extent of the stepped operative flight and moving the same in such a way as to enable them to be discharged into the outlet opening in the receiving side of said chamber to be subsequently processed.

35. The method as defined in claim 34 wherein said mixture comprises threshed leaf tobacco.

36. The method as defined in claim 34 wherein said inlet opening and said outlet opening are constructed and arranged such that the separation chamber can be mounted in side by side relation to a similar separation chamber having a similar inlet such that the particles which pass through the outlet opening of said separation chamber move through the similar inlet of the similar separation device.

* * * * *